US011669049B2

(12) United States Patent
Takasawa

(10) Patent No.: US 11,669,049 B2
(45) **Date of Patent: *Jun. 6, 2023**

(54) WATCH COMPONENT AND WATCH

(71) Applicant: Seiko Epson Corporation, Tokyo (JP)

(72) Inventor: Koki Takasawa, Suwa (JP)

(73) Assignee: SEIKO EPSON CORPORATION

( * ) Notice: Subject to any disclaimer, the term of this patent is extended or adjusted under 35 U.S.C. 154(b) by 39 days.

This patent is subject to a terminal disclaimer.

(21) Appl. No.: 17/083,388

(22) Filed: Oct. 29, 2020

(65) Prior Publication Data

US 2021/0132545 A1 May 6, 2021

(30) Foreign Application Priority Data

Oct. 30, 2019 (JP) ..... JP2019-197477

(51) Int. Cl.

| | |
|---|---|
| ***G04B 37/22*** | (2006.01) |
| ***C22C 38/48*** | (2006.01) |
| ***C22C 38/44*** | (2006.01) |
| ***C22C 38/42*** | (2006.01) |
| ***C22C 38/00*** | (2006.01) |
| ***G04B 37/00*** | (2006.01) |

(52) U.S. Cl.

CPC ..... *G04B 37/22* (2013.01); *C22C 38/001* (2013.01); *C22C 38/002* (2013.01); *C22C 38/42* (2013.01); *C22C 38/44* (2013.01); *C22C 38/48* (2013.01); *G04B 37/0008* (2013.01); *C21D 2211/001* (2013.01); *C21D 2211/005* (2013.01)

(58) Field of Classification Search

None

See application file for complete search history.

(56) References Cited

U.S. PATENT DOCUMENTS

| | | | | |
|---|---|---|---|---|
| 7,875,128 | B2 * | 1/2011 | Kuroda | C22C 38/20 420/34 |
| 8,303,168 | B2 | 11/2012 | Takasawa | |
| 2006/0130938 | A1 | 6/2006 | Kramer | |
| 2007/0217293 | A1 | 9/2007 | Takasawa | |
| 2017/0088912 | A1 | 3/2017 | Fukuda et al. | |

FOREIGN PATENT DOCUMENTS

| | | | |
|---|---|---|---|
| JP | 2000-155182 | A | 6/2000 |
| JP | 2005-097682 | A | 4/2005 |
| JP | 2007-056301 | A | 3/2007 |
| JP | 2007-239060 | A | 9/2007 |
| JP | 2007-248397 | A | 9/2007 |
| JP | 2009-069049 | A | 4/2009 |
| JP | 2013-101157 | A | 5/2013 |
| WO | 2021-100687 | A1 | 5/2021 |

* cited by examiner

*Primary Examiner* — Seth Dumbris
*Assistant Examiner* — Kim S. Horger
(74) *Attorney, Agent, or Firm* — Harness, Dickey & Pierce, P.L.C.

(57) ABSTRACT

A watch component comprising an austenitic ferritic stainless steel. The austenitic ferritic stainless steel includes a base portion composed of a ferrite phase, a surface layer composed of an austenitic phase, and a mixed layer formed between the base portion and the surface layer, wherein the mixed layer is composed of the ferrite phase and the austenitic phase. The surface layer contains 1.0 to 1.6 mass % of nitrogen, in which the surface layer has, at a surface of the surface layer, an oxide film having a thickness of 2.5 nm or greater, as calculated in terms of oxygen profiles in AES analysis.

12 Claims, 3 Drawing Sheets

WATCH COMPONENT AND WATCH

The present application is based on, and claims priority from JP Application Serial Number 2019-197477, filed Oct. 30, 2019, the disclosure of which is hereby incorporated by reference herein in its entirety.

BACKGROUND

1. Technical Field

The present disclosure relates to a watch component and a watch.

2. Related Art

There is disclosed, in JP 2007-56301 A, a watch exterior component composed by layering a coated film layer formed by a wet plating method and a coated film layer formed by a dry plating method on a base material made of stainless steel.

In JP 2007-56301 A, a plurality of the coated film layers are layered on the base material to achieve a premium feel, and to make the appearance quality less likely to deteriorate.

Unfortunately, in JP 2007-56301 A, there is an issue in that a plurality of types of the plating methods need to be combined to layer the coated film layers on the base material, to thus cause the production process to become complicated.

SUMMARY

A watch component of the present disclosure includes an austenitic ferritic stainless steel, the austenitic ferritic stainless steel including a base portion composed of a ferrite phase, a surface layer composed of an austenitic phase, and a mixed layer formed between the base portion and the surface layer, the mixed layer being composed of the ferrite phase and the austenitic phase, in which the base portion contains Cr: 18 to 22 mass %, Mo: 1.3 to 2.8 mass %, Nb: 0.05 to 0.50 mass %, Cu: 0.1 to 0.8 mass %, Ni: less than 0.5 mass %, Mn: less than 0.8 mass %, Si: less than 0.5 mass %, P: less than 0.10 mass %, S: less than 0.05 mass %, N: less than 0.05 mass %, C: less than 0.05 mass %, and a balance being composed of Fe and inevitable impurities, in which the surface layer contains 1.0 to 1.6 mass % of nitrogen, in which the surface layer includes, at a surface of the surface layer, an oxide film having a thickness of 2.5 nm or greater, as calculated in terms of oxygen profiles in AES analysis.

DESCRIPTION OF EXEMPLARY EMBODIMENTS

Embodiments

Hereinafter, a watch 1 of an embodiment of the present disclosure is described based on the drawings.

Figure 1:
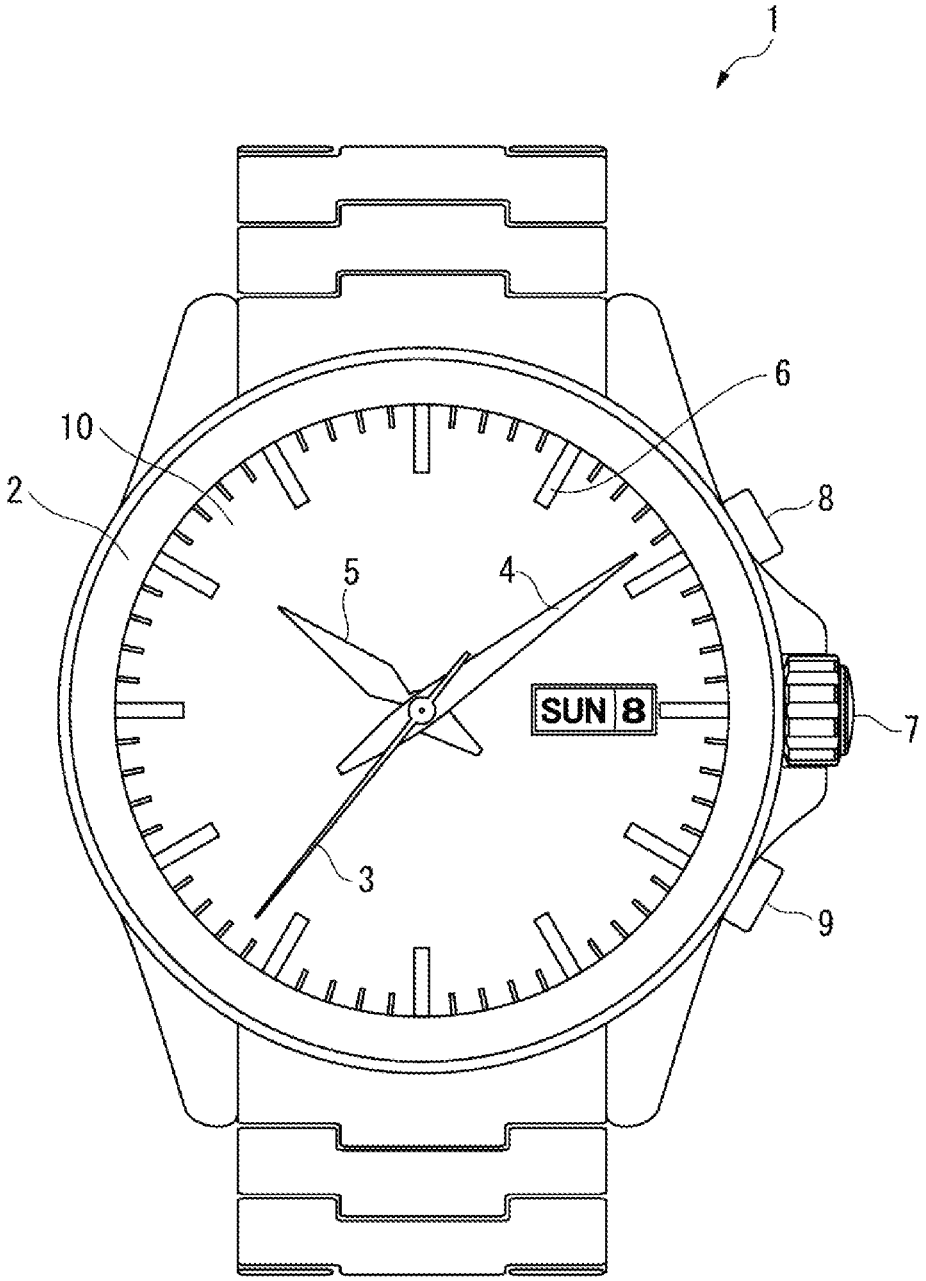
FIG. 1 is a front view illustrating a watch of an embodiment of the present disclosure.

FIG. 1 is a front view illustrating the watch 1. In the embodiment, the watch 1 is configured as a wristwatch worn on a wrist of a user.

As illustrated in FIG. 1, the watch 1 includes a case 2 made of metal. Further, at an interior of the case 2, there are provided a dial plate 10 having a disk shape, a seconds hand 3, a minute hand 4, an hour hand 5, a crown 7, an A button 8, and a B button 9. Note that the case 2 is an example of a watch component of the present disclosure.

The dial plate 10 is provided with an hour mark 6 for indicating time.

Case

Figure 2:
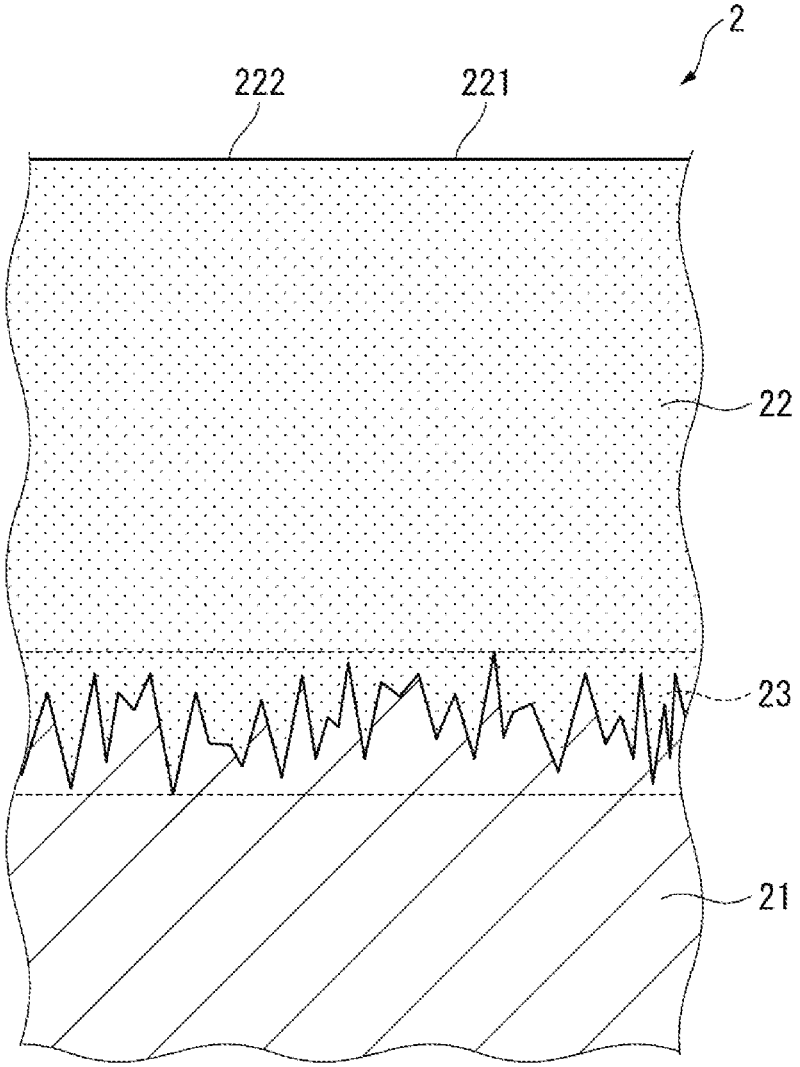
FIG. 2 is a cross-sectional view illustrating a main portion of a case.

FIG. 2 is a cross-sectional view illustrating a main portion of the case 2. Note that FIG. 2 illustrates the case 2 by a cross-sectional view cut from a surface 221 in a depth direction.

As illustrated in FIG. 2, the case 2 includes a base portion 21 composed of a ferrite phase, a surface layer 22 composed of an austenitic phase, and a mixed layer 23 composed of the ferrite phase and the austenitic phase, and is made of an austenitic ferritic stainless steel.

Base Portion

The base portion 21 is made of a ferritic stainless steel containing, by mass %, Cr: 18 to 22%, Mo: 1.3 to 2.8%, Nb: 0.05 to 0.50%, Cu: 0.1 to 0.8%, Ni: less than 0.5%, Mn: less than 0.8%, Si: less than 0.5%, P: less than 0.10%, S: less than 0.05%, N: less than 0.05%, C: less than 0.05%, and a balance being composed of Fe and inevitable impurities.

The Cr is an element that increases, in a nitrogen absorption treatment, a transfer rate of nitrogen to the ferrite phase and a diffusion rate of nitrogen in the ferrite phase. The Cr content falling below 18% decreases the transfer rate and diffusion rate of nitrogen. Further, the Cr content falling below 18% decreases corrosion resistance of the surface layer 22. On the other hand, the Cr content exceeding 22% causes hardening to deteriorate processability as a material. Moreover, the Cr content exceeding 22%, impairs the aesthetic appearance. Accordingly, it is preferred that the Cr content range from 18 to 22%, more preferred that the content range from 20 to 22%, and further preferred that the content range from 19.5 to 20.5%.

The Mo is an element that increases, in the nitrogen absorption treatment, the transfer rate of nitrogen to the ferrite phase and the diffusion rate of nitrogen in the ferrite phase. The Mo content falling below 1.3% decreases the transfer rate and diffusion rate of nitrogen. Moreover, the Mo content falling below 1.3% decreases corrosion resistance as a material. On the other hand, the Mo content exceeding 2.8% causes hardening to deteriorate processability as a material. Moreover, the Mo content exceeding 2.8% causes a constituent tissue of the surface layer 22 to become significantly heterogeneous to impair the aesthetic appearance. Accordingly, it is preferred that the Mo content range from 1.3 to 2.8%, and more preferred that the content range from 1.8 to 2.8%, and further preferred that the content range from 2.25 to 2.35%.

The Nb is an element that increases, in the nitrogen absorption treatment, the transfer rate of nitrogen to the ferrite phase and the diffusion rate of nitrogen in the ferrite phase. The Nb content falling below 0.05% decreases the transfer rate and diffusion rate of nitrogen. On the other hand, the Nb content exceeding 0.50% causes hardening to deteriorate processability as a material. Moreover, the Nb promotes formation of a deposited portion to impair the aesthetic appearance. Accordingly, it is preferred that the Nb content range from 0.05 to 0.50%, more preferred that the content range from 0.05 to 0.35%, and further preferred that the content range from 0.15 to 0.25%.

The Cu is an element that controls an absorption of nitrogen in the ferrite phase, in the nitrogen absorption treatment. The Cu content falling below 0.1% increases a variation of nitrogen content in the ferrite phase. On the other hand, the Cu content exceeding 0.8% decreases the transfer rate of nitrogen to the ferrite phase. Accordingly, it is preferred that the Cu content range from 0.1 to 0.8%, more preferred that the content range from 0.1 to 0.2%, and further preferred that the content range from 0.1 to 0.15%.

The Ni is an element that inhibits, in the nitrogen absorption treatment, a transfer of nitrogen to the ferrite phase and a diffusion of nitrogen in the ferrite phase. The Ni content being not less than 0.5% decreases the transfer rate and diffusion rate of nitrogen. Moreover, the corrosion resistance is impaired, and it may be difficult to prevent the occurrence of metal allergies and the like. Accordingly, it is preferred that the Ni content be less than 0.5%, more preferred that the content be less than 0.2%, and further preferred that the content be less than 0.1%.

The Mn is an element that inhibits, in the nitrogen absorption treatment, the transfer of nitrogen to the ferrite phase and the diffusion of nitrogen in the ferrite phase. The Mn content being not less than 0.8% decreases the transfer rate and diffusion rate of nitrogen. Accordingly, it is preferred that the Mn content be less than 0.8%, more preferred that the content be less than 0.5%, and further preferred that the content be less than 0.1%.

The Si is an element that inhibits, in the nitrogen absorption treatment, the transfer of nitrogen to the ferrite phase and the diffusion of nitrogen in the ferrite phase. The Si content being not less than 0.5% decreases the transfer rate and diffusion rate of nitrogen. Accordingly, it is preferred that the Si content be less than 0.5%, and more preferred that the content be less than 0.3%.

The P is an element that inhibits, in the nitrogen absorption treatment, the transfer of nitrogen to the ferrite phase and the diffusion of nitrogen in the ferrite phase. The P content being not less than 0.10% decreases the transfer rate and diffusion rate of nitrogen. Accordingly, it is preferred that the P content be less than 0.10%, and more preferred that the content be less than 0.03%.

The S is an element that inhibits, in the nitrogen absorption treatment, the transfer of nitrogen to the ferrite phase and the diffusion of nitrogen in the ferrite phase. The S content being not less than 0.05% decreases the transfer rate and diffusion rate of nitrogen. Accordingly, it is preferred that the S content be less than 0.05%, and more preferred that the content be less than 0.01%.

The N is an element that inhibits, in the nitrogen absorption treatment, the transfer of nitrogen to the ferrite phase and the diffusion of nitrogen in the ferrite phase. The N content being not less than 0.05% decreases the transfer rate and diffusion rate of nitrogen. Accordingly, it is preferred that the N content be less than 0.05%, and more preferred that the content be less than 0.01%.

The C is an element that inhibits, in the nitrogen absorption treatment, the transfer of nitrogen to the ferrite phase and the diffusion of nitrogen in the ferrite phase. The C content being not less than 0.05%, decreases the transfer rate and diffusion rate of nitrogen. Accordingly, it is preferred that the C content be less than 0.05%, and more preferred that the content be less than 0.02%.

Surface Layer

The surface layer 22 is formed by subjecting the base portion 21 to the nitrogen absorption treatment. In the embodiment, the surface layer 22 contains, by mass %, 1.0 to 1.6% of nitrogen.

Also, in the embodiment, the surface layer 22 includes, at the surface 221, an oxide film 222 having corrosion resistance, that is, a passivation coating film. Further, the passivation coating film has a thickness of 2.5 nm or greater, as calculated in terms of oxygen profiles in AES analysis. Note that the oxide film 222 has a thickness determined by the composition of the base portion 21 that is to be the mother material, and thus the upper limit value of the thickness is approximately 5.5 nm, for example. That is, the oxide film 222 of the embodiment has a thickness of 2.5 nm or greater and 5.5 nm or less, and it is preferred that the thickness be 3.0 nm or greater and 5.0 nm or less.

Here, in the embodiment, the oxide film 222 has, as described above, a significantly thin thickness relative to the case 2, and thus FIG. 2 illustrates the oxide film 222 by the same line as the line that defines the surface 221.

In addition, the surface 221 of the surface layer 22 coincides with a surface on an exposed side of the surface layer 22, that is, a surface on an opposite side from the mixed layer 23.

Note that a method for measuring a thickness of the passivation coating film by AES analysis will be described later.

Mixed Layer

In a process of forming the surface layer 22, the mixed layer 23 is formed due to a variation in the transfer rate of nitrogen entering into the base portion 21 that is composed of the ferrite phase. That is, at a location at which the transfer rate of nitrogen is high, the nitrogen enters into a deep portion of the base portion 21 to be austenitized, while at a location at which the transfer rate of nitrogen is low, the nitrogen is austenitized only up to a shallow portion of the base portion 21, and thus the mixed layer 23 is formed in which the ferrite phase is mixed with the austenitic phase in the depth direction.

Next, specific examples of the present disclosure will be described.

Example 1

First, as listed in Table 1, a mother material was produced, which is made of a ferritic stainless steel containing, by mass %, Cr: 20%, Mo: 2.1%, Nb: 0.2%, Cu: 0.1%, Ni: 0.05%, Mn: 0.5%, Si: 0.3%, P: 0.03%, S: 0.01%, N: 0.01%, C: 0.02%, and a balance being composed of Fe and inevitable impurities.

Next, the mother material was subjected to a nitrogen absorption treatment to obtain a metal material in which an austenitized surface layer is formed on a surface of a base portion. The metal material was then processed to produce a case.

The nitrogen absorption treatment was conducted by the method described below.

First, prepared are a nitrogen absorption treatment device that includes a processing chamber surrounded by an insulating material such as a glass fiber, a heating means for heating inside of the processing chamber, a depressurization means for depressurizing the inside of the processing chamber, and a nitrogen gas introduction means for introducing a nitrogen gas into the processing chamber.

Next, the mother material described above was placed inside the processing chamber of the nitrogen absorption treatment device, to then cause the depressurization means to depressurize the inside of the processing chamber down to 2 Pa.

Next, the nitrogen gas introduction means was used to introduce the nitrogen gas while causing the depressurization means to exhaust the inside of the processing chamber, to hold the pressure inside the processing chamber at a pressure from 0.08 to 0.12 MPa. In this state, the heating means was used to raise a temperature inside the processing chamber up to 1200° C. at a rate of 5° C./min, to then hold the temperature of 1200° C. for four hours.

Lastly, the mother material was quenched by water cooling. As a result, the austenitized surface layer was formed, to obtain the metal material having a mixed layer composed of an austenitic phase and a ferrite phase between the base portion and the surface layer. In addition, at a surface of the surface layer, mainly, the Cr reacts with oxygen and the like in the atmosphere, to form an oxide film.

Examples 2 to 9

The compositions of the ferritic stainless steels that compose the mother materials are listed in Table 1, where the mother materials are subjected to the nitrogen absorption treatment similar to that of Example 1, to obtain the metal materials. The metal materials were then processed to produce the cases. Note that processing times in Examples 2 to 10 were each determined according to a preliminary experiment. Note that processing times in Comparative Examples 1 to 3 were each determined according to a preliminary experiment.

Comparative Examples 1 to 3

The compositions of the ferritic stainless steels that compose the mother materials are listed in Table 1, where the mother materials are subjected to the nitrogen absorption treatment similar to that of Example 1, to obtain the metal materials. The metal materials were then processed to produce the cases.

TABLE 1

| | Content [mass %] | | | | | | | | | | |
|---|---|---|---|---|---|---|---|---|---|---|---|
| | Cr | Mo | Nb | Cu | Ni | Mn | Si | P | S | N | C |
| Example 1 | 20 | 2.1 | 0.2 | 0.1 | 0.05 | 0.5 | 0.3 | 0.030 | 0.010 | 0.01 | 0.02 |
| Example 2 | 18 | 2.0 | 0.2 | 0.1 | 0.05 | 0.5 | 0.3 | 0.030 | 0.010 | 0.01 | 0.01 |
| Example 3 | 22 | 2.3 | 0.2 | 0.1 | 0.05 | 0.5 | 0.3 | 0.030 | 0.010 | 0.01 | 0.03 |
| Example 4 | 19 | 2.3 | 0.2 | 0.1 | 0.05 | 0.8 | 0.3 | 0.030 | 0.010 | 0.01 | 0.03 |
| Example 5 | 20 | 1.9 | 0.2 | 0.1 | 0.05 | 0.5 | 0.3 | 0.040 | 0.010 | 0.01 | 0.03 |
| Example 6 | 20 | 2.6 | 0.2 | 0.1 | 0.05 | 0.5 | 0.3 | 0.030 | 0.010 | 0.01 | 0.03 |
| Example 7 | 18 | 2.2 | 0.3 | 0.1 | 0.05 | 0.5 | 0.5 | 0.030 | 0.010 | 0.02 | 0.02 |
| Example 8 | 21 | 2.4 | 0.1 | 0.1 | 0.05 | 0.5 | 0.3 | 0.030 | 0.040 | 0.01 | 0.02 |
| Example 9 | 21 | 2.1 | 0.3 | 0.1 | 0.50 | 0.6 | 0.3 | 0.030 | 0.010 | 0.01 | 0.02 |
| Comparative Example 1 | 25.3 | — | 0.0 | 0.01 | 0.01 | 0.2 | 0.5 | 0.009 | 0.001 | 0.02 | 0.03 |
| Comparative Example 2 | 18.3 | 2.3 | 0.2 | — | — | 0.3 | 0.2 | 0.022 | 0.001 | 0.02 | 0.01 |
| Comparative Example 3 | 25.8 | 2.0 | — | — | <0.01 | — | — | <0.002 | 0.002 | 0.02 | 0.00 |

Measurement of Thickness of Oxide Film

As for the metal material produced in each of the above-described examples and comparative examples, a thickness of the oxide film formed on the surface was measured by Auger Electron Spectroscopy (AES) analysis. Specifically, the thicknesses of the oxide films were calculated in terms of oxygen profiles as a result of the AES analysis.

Note that analytical conditions of this test are set out below:

Acceleration voltage: 10 kV

Probe current: 10 nA

Spatter rate: 3.5 nm/min—as calculated in terms of $SiO_2$

Ion gun condition: 1 kV 1 mm

Measurement items: C, O, NCr, Fe, Ni, Mo, and Nb

Measurement of Pitting Potential

A pitting potential of the metal material produced in each of the above-described examples and comparative examples was measured based on JIS G0577. Note that a "5% (mass fraction) sodium chloride aqueous solution" was used as the test solution in this measurement.

Determination of Corrosion Resistance

A corrosion resistance was determined for the metal material produced in each of the above-described examples and comparative examples. Specifically, at any location of the metal material, an area is selected, which is surrounded by a square 90 μm on a side, and the area is divided into 256 pieces. To the individual areas thus divided, a voltage of 10V was applied by Scanning Probe Microscope (SPM), to measure a current value at this time. That is, current values at the 256 points were measured by the SPM. Note that in the present disclosure, the measurement using the SPM as such is referred to as SPM measurement.

The corrosion resistances were then determined from the measured current values by the following criteria:

—Criteria—

A: The maximum value of current value is not greater than $1*10^{-9}$ nA

B: The maximum value of current value is greater than $1*10^{-9}$ nA and less than $1*10^{-8}$ nA C: The maximum value of current value is not less than $1*10^{-8}$ nA Evaluation Result: Measurement of Thickness of Oxide Film As listed in Table 2, in Examples 1 to 9 of the present disclosure, the thicknesses of the oxide films range from 2.7 to 5.0 nm, as calculated in terms of oxygen profiles. On the other hand, in Comparative Examples 1 to 3, the thicknesses of the oxide films range from 2.0 to 2.4 nm. In view of the above, the compositions of the ferritic stainless steels that compose the mother materials in Examples 1 to 9 of the present disclosure are listed in Table 1, where it is inferred that the oxide films having thicknesses greater than those of the oxide films in Comparative Examples 1 to 3 may be formed by subjecting the mother materials to the nitrogen absorption treatment.

As such, in Examples 1 to 9 of the present disclosure, the compositions of the ferritic stainless steels that compose the mother materials are adjusted to form the oxide films having thicknesses greater than those of the oxide films in Comparative Examples 1 to 3, to thus enhance the corrosion resistance. That is, in Examples 1 to 9 of the present disclosure, high corrosion resistance can be achieved by simply adjusting the compositions of the mother materials, and it is indicated that the production process can be simplified compared to when performing a plurality of types of plating processes, for example.

Evaluation Result: Measurement of Pitting Potential

As listed in Table 2, in Examples 1 to 9 of the present disclosure, the pitting potential ranges from 900 to 1150 mV. On the other hand, in Comparative Examples 1 to 3, the pitting potential ranges from 700 to 750 mV. This indicates that in Examples 1 to 9 of the present disclosure, high corrosion resistance is achieved due to the high pitting potential compared to Comparative Examples 1 to 3.

Figure 3:
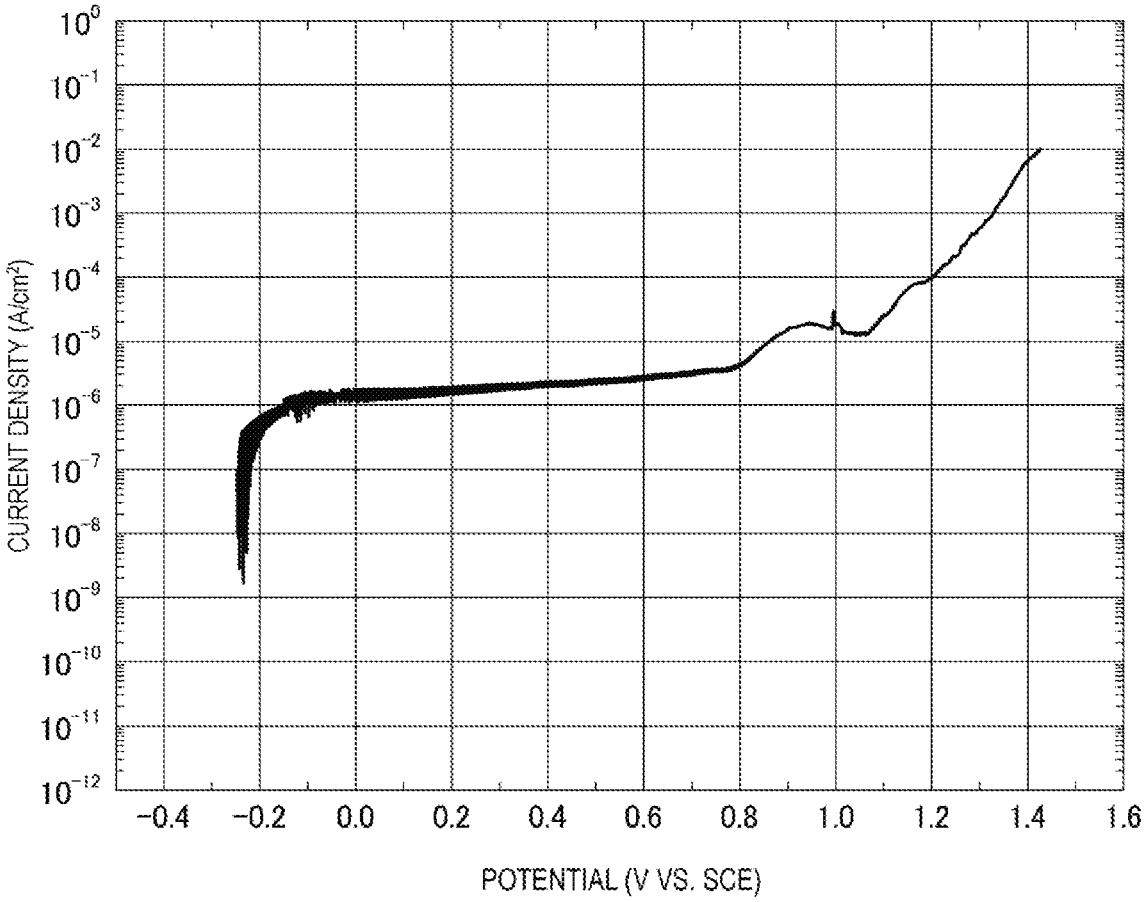
FIG. 3 is a graph illustrating a result of pitting potential measurement test.

Further, as an example, FIG. 3 illustrates a test result of the pitting potential in Example 1.

As illustrated in FIG. 3, in Example 1 of the present disclosure, the current density once rises around a point at which the potential exceeds 800 mV, and then drops around a point at which the potential exceeds 1000 mV. From the above, it is inferred that secondary passivation may occur in the oxide films at a potential of 1000 mV or higher. That is, it is considered that the oxide film of Example 1 may have a secondary passivation region at the potential of 1000 mV or higher. Note that, in Examples 2 to 9 as well, a phenomenon similar to the above occurs at the potential of 1000 mV or higher. On the other hand, in Comparative Examples 1 to 3, the phenomenon described as above does not occur. That is, in Comparative Examples 1 to 3, because a dissolution of the base material by the pitting potential occurs at a potential of 600 mV or higher, it is inferred that the secondary passivation may not occur in the oxide films.

As such, in Examples 1 to 9 of the present disclosure, because the oxide film has the secondary passivation region at the potential of 1000 mV or higher, it is indicated that the oxide films have further high corrosion resistance.

Evaluation Result: Determination of Corrosion Resistance

As listed in Table 2, in Examples 1 to 9 of the present disclosure, determination results of the corrosion resistance are "A". That is, in Examples 1 to 9, at all of the 256 points, it is observed that the current values are not greater than $1*10^{-9}$ nA, where high electrical resistance value is achieved. On the other hand, in Comparative Example 2, the determination result of the corrosion resistance is "B", and in Comparative Examples 1 and 3, the determination results of the corrosion resistance are "C". That is, in Comparative Examples 1 to 3, the maximum values of the current values are greater than $1*10^{-9}$, where a point is found at which the current resistance value becomes low.

Note that a measurement result of the current value when a voltage of −10V is applied by the SPM measurement is the same as the above. That is, in Examples 1 to 9, the current values are not less than $-1*10^{-9}$ nA at all of the points, while in Comparative Examples 1 to 3, the maximum values of the current values are less than $-1*10^{-9}$ nA.

As a result, in Examples 1 to 9 of the present disclosure, because high electrical resistance value is achieved at all of the points, it is inferred that the oxide films may be evenly formed. On the other hand, in Comparative Examples 1 to 3, because there is a point at which the electrical resistance value becomes low, it is inferred that the oxide film may be unevenly formed.

As such, in Examples 1 to 9 of the present disclosure, the oxide films are evenly formed, thus it is indicated that the oxide films have high corrosion resistance.

TABLE 2

| | Pitting Potential [mV] | Thickness of Oxide Film [nm] | Determination of Corrosion Resistance [—] |
|---|---|---|---|
| Example 1 | 1100 | 4.9 | A |
| Example 2 | 1000 | 4.2 | A |
| Example 3 | 1150 | 5.0 | A |
| Example 4 | 1100 | 4.4 | A |
| Example 5 | 1050 | 3.9 | A |
| Example 6 | 1150 | 4.6 | A |
| Example 7 | 1100 | 3.8 | A |
| Example 8 | 900 | 2.7 | A |
| Example 9 | 1050 | 4.1 | A |
| Comparative Example 1 | 700 | 2.1 | C |
| Comparative Example 2 | 750 | 2.4 | B |
| Comparative Example 3 | 700 | 2.0 | C |

Modification Examples

Note that the present disclosure is not limited to the embodiment described above, and modifications, improvements, and the like within the scope in which the object of the present disclosure can be achieved are included in the present disclosure.

In the embodiment described above, the watch component of the present disclosure is configured as the case 2, but is not limited to this. For example, the watch component of the present disclosure may be configured as a bezel, a back lid, a band, a crown, a button, or the like.

In the embodiment described above, the metal material in which the ferritic stainless steel of the present disclosure composes the mother material constitutes, but not limited to, the watch component. For example, the metal material of the present disclosure may constitute a case of an electronic apparatus other than the watch, that is, a component for the electronic apparatus such as a housing. A provision of the housing, which is constituted by such a metal material, enables the electronic apparatus to have high hardness, corrosion resistance.

Summary of Present Disclosure

A watch component of the present disclosure is composed of an austenitic ferritic stainless steel, the austenitic ferritic stainless steel including a base portion composed of a ferrite phase, a surface layer composed of an austenitic phase, and a mixed layer formed between the base portion and the surface layer, the mixed layer being composed of the ferrite phase and the austenitic phase, in which the base portion contains, by mass %, Cr: 18 to 22%, Mo: 1.3 to 2.8%, Nb: 0.05 to 0.50%, Cu: 0.1 to 0.8%, Ni: less than 0.5%, Mn: less than 0.8%, Si: less than 0.5%, P: less than 0.10%, S: less than 0.05%, N: less than 0.05%, C: less than 0.05%, and a balance being composed of Fe and inevitable impurities, in which the surface layer contains, by mass %, 1.0 to 1.6% of nitrogen, in which the surface layer has, at a surface of the surface layer, an oxide film having a thickness of 2.5 nm or greater, as calculated in terms of oxygen profiles in AES analysis.

In the watch component of the present disclosure, the oxide film may have a secondary passivation region at a potential of 1000 mV or higher in pitting potential measurement test based on JIS G0577.

In the watch component of the present disclosure, the oxide film may exhibit a drop in current density at a potential of 1000 mV or higher in pitting potential measurement test based on JIS G0577.

In the watch component of the present disclosure, the oxide film may have a maximum value of current value of $1*10^{-9}$ nA or less when a voltage of 10V is applied in SPM measurement.

A watch of the present disclosure includes the watch component.

What is claimed is:

1. An austenitic ferritic stainless steel comprising:

a base portion composed of a ferrite phase;

a surface layer composed of an austenitic phase; and a mixed layer formed between the base portion and the surface layer, and in which the ferrite phase and the austenitic phase are mixed wherein the base portion contains Cr: 18 to 22 mass %, Mo: 1.3 to 2.8 mass %, Nb: 0.30 to 0.50 mass %, Cu: 0.1 to 0.2 mass %, Ni: less than 0.5 mass %, Mn: 0.5 to 0.8 mass %, Si: less than 0.5 mass %, P: less than 0.10 mass %, S: less than 0.05 mass %, N: less than 0.05 mass %, C: less than 0.05 mass %, and a balance being composed of Fe and inevitable impurities, wherein the surface layer contains 1.0 to 1.6 mass % of nitrogen, wherein the surface layer includes, at a surface of the surface layer, an oxide film having a thickness of 2.5 nm or greater, as calculated using oxygen profiles obtained by AES analysis.

2. The austenitic ferritic stainless steel of claim 1, wherein the oxide film has a secondary passivation region at a potential of 1000 mV or higher in pitting potential measurement test based on JIS G0577.

3. The austenitic ferritic stainless steel of claim 1, wherein the oxide film exhibits a drop in current density at a potential of 1000 mV or higher in pitting potential measurement test based on JIS G0577.

4. The austenitic ferritic stainless steel of claim 2, wherein the oxide film exhibits a drop in current density at a potential of 1000 mV or higher in pitting potential measurement test based on JIS G0577.

5. The austenitic ferritic stainless steel of claim 1, wherein the oxide film has a maximum value of current value of $1*10^{-9}$ nA or less when 10V is applied in SPM measurement.

6. The austenitic ferritic stainless steel of claim 2, wherein the oxide film has a maximum value of current value of $1*10^{-9}$ nA or less when 10V is applied in SPM measurement.

7. The austenitic ferritic stainless steel of claim 3, wherein the oxide film has a maximum value of current value of $1*10^{-9}$ nA or less when 10V is applied in SPM measurement.

8. The austenitic ferritic stainless steel of claim 4, wherein the oxide film has a maximum value of current value of $1*10^{-9}$ nA or less when 10V is applied in SPM measurement.

9. A watch component comprising the austenitic ferritic stainless steel according to claim 1.

10. A watch component comprising the austenitic ferritic stainless steel according to claim 2.

11. A watch component comprising the austenitic ferritic stainless steel according to claim 3.

12. A watch component comprising the austenitic ferritic stainless steel according to claim 4.

* * * * *